US005140312A

United States Patent [19]

Ishii

[11] Patent Number: 5,140,312

[45] Date of Patent: Aug. 18, 1992

[54] DISPLAY APPARATUS

[75] Inventor: Takatoshi Ishii, Tokyo, Japan

[73] Assignee: Ascii Corporation, Tokyo, Japan

[21] Appl. No.: 470,956

[22] Filed: Jan. 26, 1990

Related U.S. Application Data

[62] Division of Ser. No. 62,151, Jun. 12, 1987, Pat. No. 4,931,785.

[30] Foreign Application Priority Data

Jun. 17, 1986 [JP] Japan ..... 61-140877
Jan. 6, 1987 [JP] Japan ..... 62-693

[51] Int. Cl.[5] ..... G09G 1/28
[52] U.S. Cl. ..... 340/703; 340/799
[58] Field of Search ..... 340/703, 747, 750, 799, 340/723

[56] References Cited

U.S. PATENT DOCUMENTS

| | | | |
|---|---|---|---|
| 4,246,578 | 1/1981 | Kawasaki et al. | 340/750 |
| 4,314,357 | 2/1982 | Kimura et al. | 340/799 |
| 4,364,037 | 12/1982 | Walker | 340/703 |
| 4,459,677 | 7/1984 | Porter et al. | 340/750 |
| 4,481,594 | 11/1984 | Staggs et al. | 340/703 |
| 4,498,081 | 2/1985 | Fukushima et al. | 340/799 |
| 4,498,098 | 2/1985 | Stell | 358/22 |
| 4,665,438 | 5/1987 | Miron et al. | 358/22 |
| 4,789,854 | 12/1988 | Ishii | 340/703 |
| 4,931,785 | 6/1990 | Ishii | 340/703 |

FOREIGN PATENT DOCUMENTS

| | | |
|---|---|---|
| 1200631 | 2/1986 | Canada . |
| 2143106A | 1/1985 | United Kingdom . |
| 2167926A | 6/1986 | United Kingdom . |

OTHER PUBLICATIONS

Bruce A. Artwick, *Microcomputer Displays, Graphics and Animation.*, Prentice-Hall Inc. (1985).

*Primary Examiner*—Ulysses Weldon
*Assistant Examiner*—Xiao Min Wu
*Attorney, Agent, or Firm*—Hoffmann & Baron

[57] ABSTRACT

A display apparatus consists of a display memory (VRAM), a data modifier circuit and a display unit at least. The display unit, such as a CRT display unit, has a plurality of display dots which include red, green and blue color dots. The display memory must be cleaned at a primary stage and thereafter a plurality of display codes corresponding to only display dots on the outlines of the color image must be written into the display memory. The display codes are converted into display data which indicate red, green and blue color components. The display codes are successively read out from the display memory and supplied to the data modifier circuit wherein the display data are modified so as to compensate the display data which are not written into the display memory. The display unit displays the image corresponding to the modified display data on the screen thereof.

9 Claims, 5 Drawing Sheets

DISPLAY APPARATUS

This is a divisional of copending application Ser. No. 07/062,151 filed on Jun. 12, 1987 now U.S. Pat. No. 4,931,785.

BACKGROUND OF THE INVENTION

1. Field of the Invention

The present invention generally relates to display apparatuses, and more particularly to a display apparatus in which a plurality of image data read from a video memory (or a display memory) are supplied to a display unit wherein the image designated by the image data is displayed on a screen thereof.

2. Prior Art

Conventionally, a known display apparatus is controlled to display an image on a screen by use of a central processing unit (CPU). Such color image display apparatus includes a video random access memory (VRAM) therein which pre-stores a plurality of image data each of which corresponds to a display dot arranged on the screen. The color image data are read from the VRAM and are converted into analog color signals of R, G and B (hereinafter, analog color signals of R, G and B will be referred to as RGB signals). The RGB signals with synchronizing signals are supplied to a CRT color display unit wherein the image designated by the RGB signals are displayed on the screen thereof.

Meanwhile, the image data stored in the VRAM must be changed in order to change the image displayed on the screen of the display unit in the conventional display apparatus. In this case, the CPU gives access to the VRAM wherein all image data are displaced by other image data, hence, much time must be required for displacing the image data. In addition, it is impossible to simultaneously write the image data into the VRAM within the conventional color image display apparatus. As a result, the conventional display apparatus suffers a problem in that it is impossible to displace the image displayed on the screen with a high speed.

SUMMARY OF THE INVENTION

It is therefore a primary object of the invention to provide a display apparatus in which the image displayed on the screen can be displaced by another image with a high speed.

It is another object of the invention to provide a display apparatus in which a software process for displaying the image can be simplified so that working hours for making out the software can be remarkably reduced.

In one aspect of the invention, there is provided a display apparatus comprising: (a) display memory means for storing a plurality of display codes therein; (b) data detection means for detecting whether the display code is identical to predetermined data or not, the data detection means outputting a detection signal when the display code is identical to the predetermined data; (c) register means for storing (renewing) and outputting the display codes from the memory means successively, the register means stopping to successively renew the display codes and outputting a preceding display code instead of the display code corresponding to the detection signal when the detection signal is supplied to the register means; and (d) display means for displaying an image corresponding to the output data of the register means.

In another aspect of the invention, there is provided a display apparatus comprising: (a) display memory means for storing a plurality of display codes and modifier codes therein; (b) data judgment means for judging whether the modifier codes are inputted therein or not, the data detection means outputting control signals corresponding to the value of the modifier code when the modifier code is inputted into the data detection means; (c) data conversion means for converting the display codes into display data; (d) data modifier means for modifying the display data based on the control signals, the data modifier means comprising (1) data register means for successively inputting the display data therein, (2) modifier means for modifying the display data stored in the data register means based on the control signals, the data register means outputting the modified display data; and (e) display means for displaying an image corresponding to the modified display data from the data register means.

BRIEF DESCRIPTION OF THE DRAWINGS

Further objects and advantages of the present invention will be apparent from the following description, reference being had to the accompanying drawings wherein preferred embodiments of the present invention are clearly shown.

In the drawings.

DESCRIPTION OF THE PREFERRED EMBODIMENTS

Figure 1:
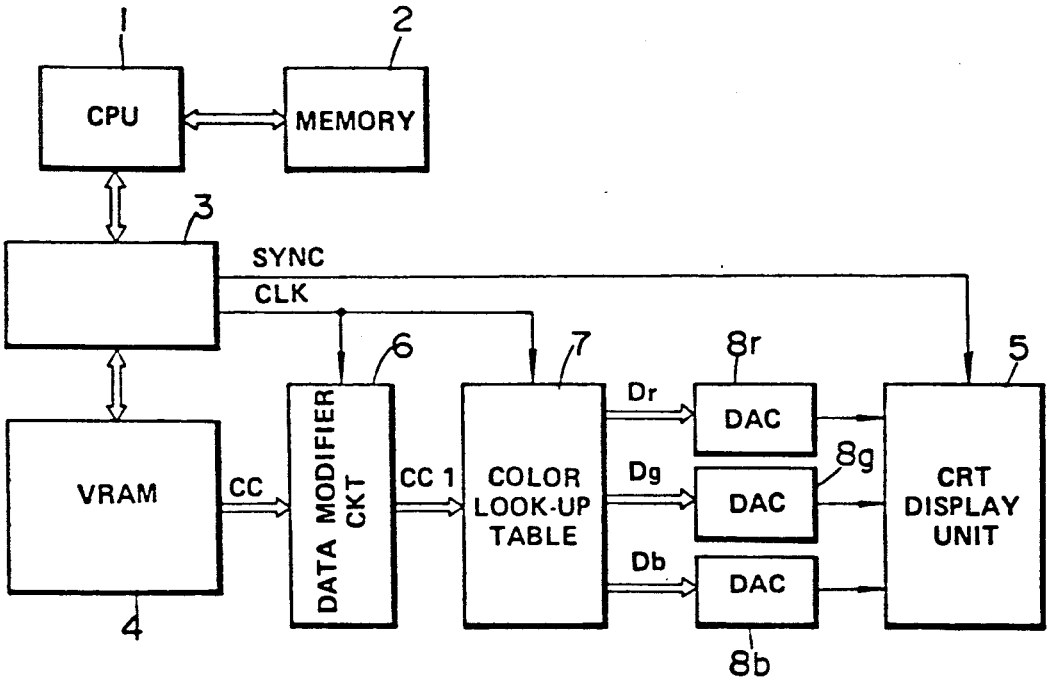
FIG. 1 is a block diagram showing a first embodiment of the present invention.

Referring now to the drawings, wherein like reference characters designate like or corresponding parts throughout the several views, FIG. 1 is a block diagram showing a first embodiment of the display apparatus according to the present invention. In FIG. 1, 1 designates a CPU, 2 designates a memory (system memory) constituted by a read only memory and a random access memory in which programs used for the CPU 1 are stored, 3 designates a display controller and 4 designates a VRAM. A CRT display unit 5 provides a plurality of display dots each of which consists of the three dot elements of R, G and B. The VRAM 4 has a plurality of storage areas (data of four bits can be stored in one storage area, for example) each of which corresponds t one display dot. Each storage area stores a color code CC (four bits) for displaying the display dot.

The display controller 3 writes the color codes CC outputted from the CPU 1 into the storage areas within the VRAM 4. The display controller 3 includes a clock generating circuit (not shown) therein for generating a dot clock CLK. When the CPU 1 outputs a display command to the display controller 3, the display controller 3 sequentially and repeatedly reads out the color codes CC (display data) from the storage areas within the VRAM 4 in accordance with a timing of the dot clock CLK. The VRAM 4 sequentially outputs the color codes to a data modifier circuit 6. In addition, the display controller 3 outputs the dot clock CLK to the data modifier circuit 6 and a color look-up table 7, and furthermore, the display controller 3 outputs a synchronizing signal SYNC to the CRT display unit 5.

Figure 2:
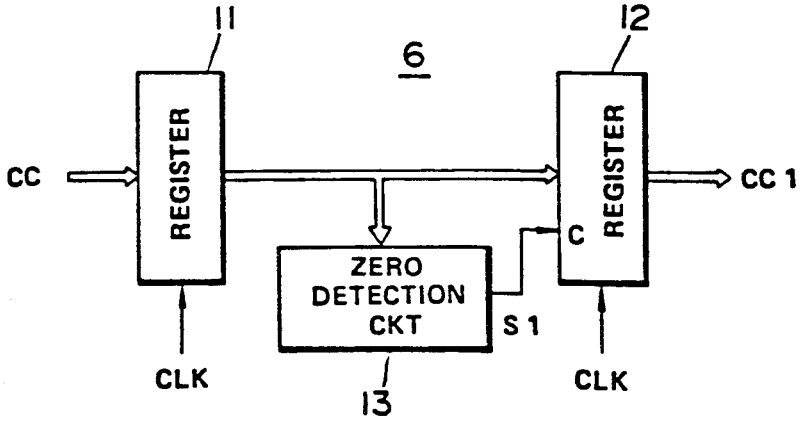
FIG. 2 is a block diagram showing a main part of the first embodiment shown in FIG. 1.

FIG. 2 shows a detailed constitution of the data modifier circuit 6. As shown in FIG. 2, the data modifier circuit 6 consists of registers 11 and 12 and a zero detection circuit 13. The register 11 reads in the color codes CC from the VRAM 4 in accordance with a timing of the dot clock CLK. The zero detection circuit 13 detects whether the value of the color code CC outputted from the register 11 is equal to zero or not. The zero detection circuit 13 outputs the detection signal $S_1$ to a control terminal C of the register 12. The level of the detection signal $S_1$ becomes "1" only when the value of the color code CC is equal to zero. The register 12 sequentially stores the color codes CC outputted from the register 11 in accordance with the dot clock CLK when the level of the detection signal $S_1$ is "0". However, the register 12 stops storing the color codes CC when the level of the detection signal $S_1$ is "1". The register 12 sequentially outputs the stored color codes CC to a color look-up table 7 shown in FIG. 1 as color codes CC1.

The color look-up table 7 converts the color code CC1 into red (R) color data $D_r$, green (G) color data $D_g$ and blue (B) color data $D_b$. These color data $D_r$, $D_g$ and $D_b$ are supplied to respective digital-to-analog converters (DAC) 8r, 8g and 8b wherein the color data $D_r$, $D_g$ and $D_b$ are respectively converted into analog signals. These analog signals are supplied to the CRT display unit 5. The CRT display unit 5 performs the color dot display based on the synchronizing signal SYNC and the analog signals outputted from the DAC 8r, 8g and 8b.

Next, description will be given with respect to the operation of the first embodiment in conjunction with FIG. 3.

Figure 3:
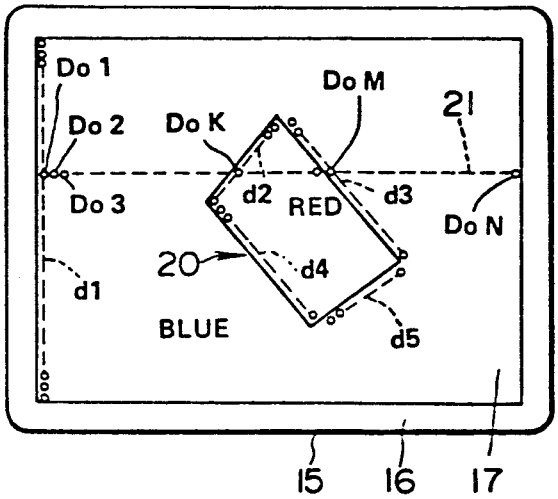
FIG. 3 shows an example of an image displayed on a screen of a display unit.

In FIG. 3, 15 designates the screen (faceplate) of the CRT display unit 5, 16 designates a border region (where the image is not displayed) and 17 designates an image display region. FIG. 3 shows an example of an image in which a red color region 20 is arranged within a blue color background region. In this case, the CPU 1 clears the VRAM 4 at an initial stage, hence, all color codes CC stored in the VRAM 4 equals to "0". Next, the blue color codes CCb are stored in the storage areas corresponding to display dots within a dot row d1 which is arranged at the left edge position of the image display region 17. Thereafter, the red color codes CCr are stored in the storage areas corresponding to display dots of dot rows d2 and d4 which are arranged in the left edge of the image 20. Next, the blue color codes CCb are stored in the storage areas corresponding to display dots of dot rows d3 and d5 which are arranged in the right edge of the image 20. Hence, the values of the color codes CC other than the color codes CCb and CCr corresponding to the dot rows d1 to d5 are all equal to "0". Next, when the display command is outputted from the CPU 1, the color code CC corresponding to the front display dot within the dot row d1 is first read out from the storage area thereof, and similarly, the color codes CC are sequentially read from the storage areas within the VRAM 4 in accordance with the dot clock CLK. The color dot display is performed based on the color codes CC read from the VRAM 4.

Next, description will be given with respect to a dot line 21 shown in FIG. 3.

First, the VRAM 4 outputs the color code CC corresponding to a display dot $D_{01}$ arranged at the left edge of the dot line 21 at a first clock timing of the dot clock CLK. This color code CC is stored in the register 11 (shown in FIG. 2) at a second clock timing of the dot clock CLK and is supplied to the register 12 and the zero detection circuit 13. The zero detection circuit detects whether the value of the color code TM CC is equal to "0" or not. In this case, the color code corresponding to the display dot $D_{01}$ is the blue color code CCb, hence, the value thereof is not equal to "0". Therefore, the value of the detection signal $S_1$ is set to "0". Next, at a third clock timing of the dot clock CLK, the blue color code CCb outputted from the register 11 is stored in the register 12 and is supplied to the color look-up table 7 wherein the blue color code CCb is converted into three color data $D_r$, $D_g$ and $D_b$ (i.e., $D_r$="0 0 0", $D_g$="0 0 0" and $D_b$="1 1 1"). These three color data $D_r$, $D_g$ and $D_b$ are converted into respective three analog signals in the DAC 8r, 8g and 8b, and these three analog signals are supplied to the CRT display unit 5 so that the blue color is displayed at the position of the display dot $D_{01}$.

Thus, when the VRAM 4 outputs the color code CC the value of which is not equal to "0", this color code CC is outputted from the register 12 after two clock timings of the dot clock CLk. This color code CC is converted into the three color data $D_r$, $D_g$ and $D_b$ and these three color data $D_r$, $D_g$ and $D_b$ are converted into three respective analog signals in the DAC 8r, 8g and 8b, so that the CRT display unit 5 performs the color dot display.

Next, the register 11 stores the color code CC corresponding to the display dot $D_{02}$ outputted from the VRAM 4. However, the color of the display dot $D_{02}$ is not selected and the value thereof equals to "0" because the VRAM 4 is cleared at the initial stage. Hence, the value of the detection signal $S_1$ becomes "1", and the register 12 does not store the color code CC corresponding to the display dot $D_{02}$ at a next clock timing of the dot clock CLK. For this reason, the blue color code CCb is still held in the register 12, therefore, the blue color is displayed at the position of the display dot $D_{02}$ as described before. Thus, the display dot corresponding to the color code CC having the value of "0" is colored by the same color corresponding to the preceding display dot.

Similarly, the color codes CC having the same value of "0" corresponding to the display dots $D_{03}$, $D_{04}$, . . . , and $D_{0(k-1)}$ are sequentially read out from the VRAM 4. Hence, the blue color is displayed at the positions of the above display dots $D_{03}$ to $D_{0(k-1)}$. Next, the red color code CCr corresponding to the display dot $D_{0k}$ the value of which does not equal to "0" is stored in the registers 11 and 12 sequentially, hence, the red color is displayed at the position of the display dot $D_{0k}$. Thereafter, the color codes CC having the same value of "0" corresponding to the display dots $D_{0(k+1)}$ to $D_{0(M-1)}$ are sequentially read from the VRAM 4. As similar to the display dots $D_{02}$ to $D_{0(k-1)}$, the red color is displayed at the positions of the display dots $D_{0(k+1)}$ to $D_{0(M-1)}$. Next, the blue color code CCb corresponding to the display dot $D_{0M}$ is read out from the VRAM 4 so that the blue color is displayed at the position of the display dot $D_{0M}$. As same to the display dots $D_{02}$ to $D_{0(k-1)}$, the color codes CC having the same value of "0" corresponding to the display dots $D_{0(M+1)}$ to $D_{0N}$ are read out from the VRAM 4, so that the blue color is displayed at the positions of the display dots $D_{0(M+1)}$ to $D_{0N}$.

Above is the description of the process for coloring the display dots within the dot line 21. Similarly, the other dot lines will be colored.

It is obvious that the constant shading operation (in which the same color is displayed in a selected region) can be performed by clearing the VRAM 4 and only setting the color codes corresponding to the display dots within outlines (such as dot rows d1 to d5 shown in FIG. 3) of regions in which selected color is displayed. Hence, the color codes of the above outlines are only needed for the VRAM 4 in the above constant shading operation in the first embodiment shown in FIG. 1. For this reason, the time for inputting the color codes into the VRAM 4 can be remarkably reduced. In other words, it is possible to display and renew the optimum image on the screen with a high speed, and it is also possible to remarkably reduce the time for making out the software for displaying the image.

Meanwhile, several kinds of dual port RAM (dynamic RAM) have been developed in these days, and a certain kind of the dual port RAM can perform a high speed copy mode. By applying such dual port RAM to the VRAM 4, it is possible to clear the data stored in the VRAM 4 with an extremely high speed.

Above is the description of the first embodiment. In the first embodiment, it is possible to exchange the data modifier circuit 6 and the color look-up table 7 shown in FIG. 1, as shown in FIG. 4.

Figure 4:
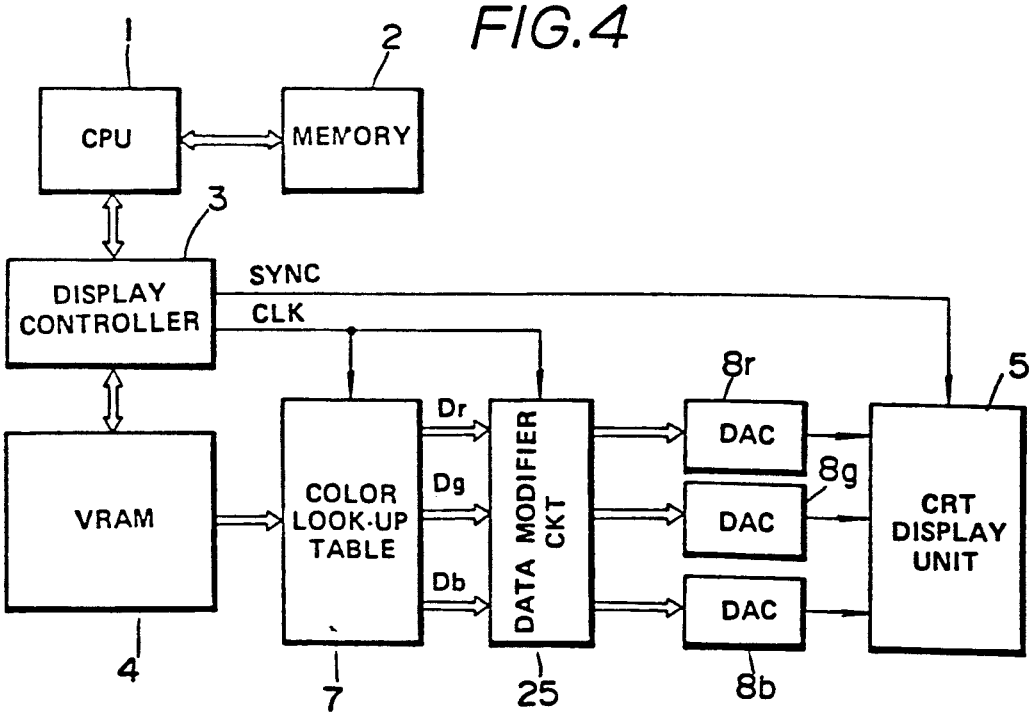
FIG. 4 is a block diagram showing a modified embodiment of the first embodiment shown in FIG. 1.

FIG. 4 shows a constitution of a modified embodiment of the first embodiment shown in FIG. 1. In FIG. 4, the VRAM 4 outputs the color codes to the color look-up table 7 wherein the color codes are converted into the three color data $D_r$, $D_g$ and $D_b$. These three color data are supplied to a data modifier circuit 25 which is constituted by first and second registers and the zero detection circuit as similar to the data modifier circuit 6 shown in FIG. 2. The color data $D_r$, $D_g$ and $D_b$ the values of which does not equal to "0" are stored in the second register (which corresponds to the register 12 shown in FIG. 2), however, the color data $D_r$, $D_g$ and $D_b$ having the same value of "0" are not stored in the second register. The color data $D_r$, $D_g$ and $D_b$ outputted from the data modifier circuit 25 are supplied to the DAC 8r, 8g and 8b wherein these three color data are converted in to the analog signals, so that the CRT display unit 5 performs the color dot display as described before.

In the above-mentioned embodiments, it is possible to stop to renew data in the second register (register 12) when the value of the data is not equal to "0" but other selected value. In this case, the zero detection circuit 13 must be displaced by a coincidence circuit for detecting whether the value of output data from the register 11 is equal to that of the selected data.

Next, description will be given with respect to the second embodiment.

Figure 5:
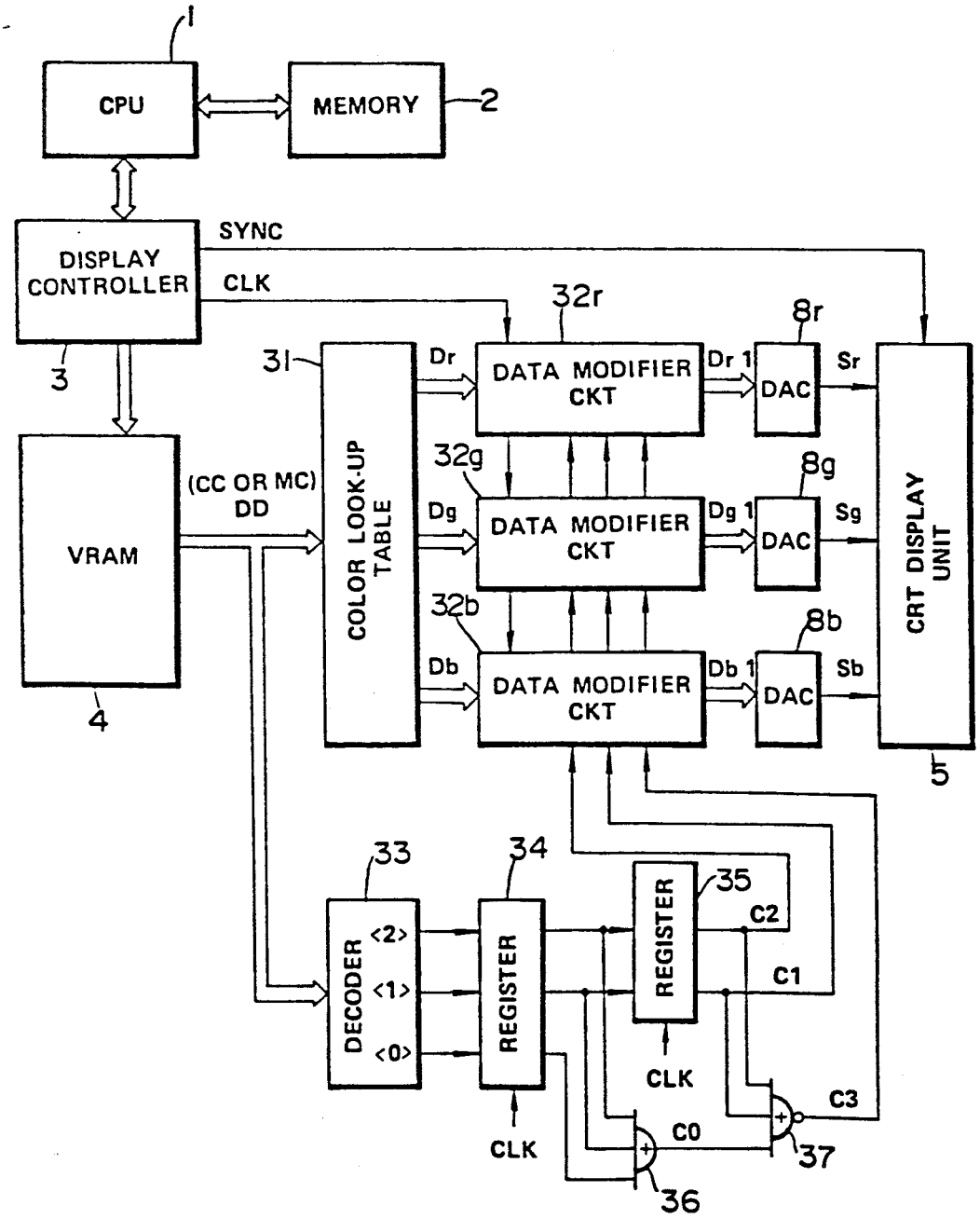
FIG. 5 is a block diagram showing a second embodiment of the present invention.

FIG. 5 shows the whole constitution of the second embodiment according to the present invention. In FIG. 5, when the CPU 1 outputs the display command to the display controller 3, a series of display data DD which are pre-stored in the VRAM 4 are sequentially read out from the VRAM 4 in accordance with the dot clock CLK. In addition, the display controller 3 generates the synchronizing signal SYNC based on the dot clock CLK and the synchronizing signal SYNC is supplied to the CRT display unit 5.

One of main differences between the first and second embodiments is that the display data DD is used instead of the color code CC.

Next, description will be given with respect to the display data DD pre-stored in the VRAM 4.

This display data DD includes the color codes CC and modifier codes MC. The modifier codes MC can take a value within "0", "1" and "2", and the color codes CC can take integral values other than the values of "0", "1" and "2". More specifically, "7", "5", "4", "9", "A", "B", "6", "5" and "9" designate the color codes CC, and "0", "1" and "2" designate the modifier codes MC in FIG. 7(b). Hence, it is inhibited to use the values of "0" to "2" for the color codes CC. The function of the modified codes MC will be described later.

In FIG. 5, 31 designates a color look-up table wherein the color codes CC from the VRAM 4 are converted into the three color data $D_r$, $D_g$ and $D_b$. These three color data $D_r$, $D_g$ and $D_b$ are supplied to respective data modifier circuits 32r, 32g and 32b. On the other hand, the modifier codes MC from the VRAM 4 are not accepted in the color look-up table 31. The three color data $D_r$, $D_g$ and $D_b$ are converted into respective modified color data $D_{r1}$, $D_{g1}$ and $D_{b1}$ by a predetermined modifier conversion in the data modifier circuit 32r, 32g and 32b. These three modified color data are supplied to the respective DAC 8r, 8g and 8b wherein three modified color data $D_{r1}$, $D_{g1}$ and $D_{b1}$ are converted into analog signals, such as a red signal $S_r$, a green signal $S_g$ and a blue signal $S_b$. These three analog signals are supplied to the CRT display unit 5, so that the CRT display unit 5 performs the dot color display. The data modifier circuit 32r, 32g and 32b have the same constitution.

Next, description will be given with respect the detailed constitution of the data modifier circuit 32r as a representative of other modifier circuits in conjunction with FIG. 6.

Figure 6:
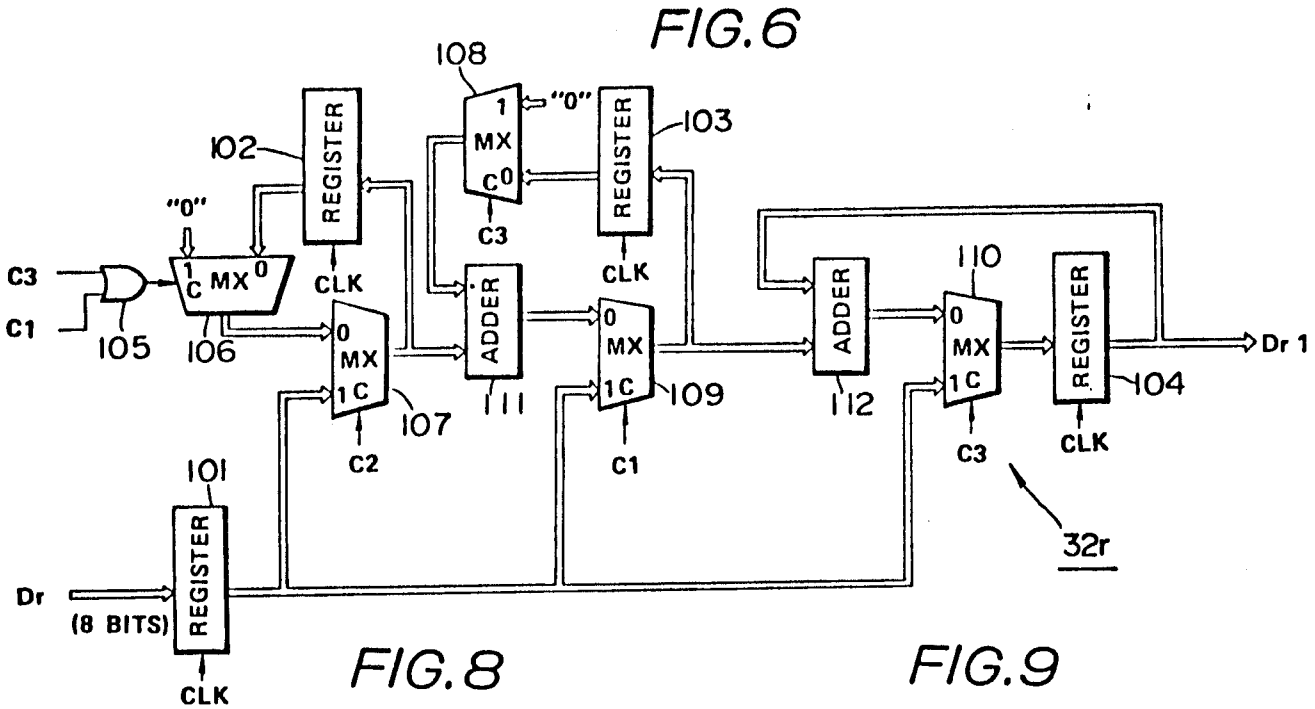
FIG. 6 is a block diagram showing a main part of the second invention shown in FIG. 5.
Figure 9:
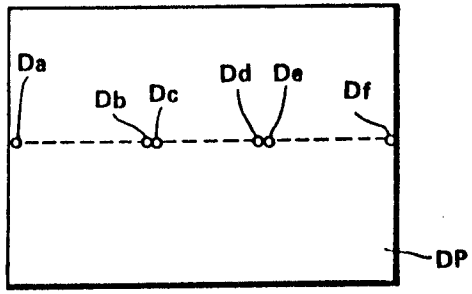
FIGS. 8 and 9 show examples of images displayed on a screen of a display unit for explaining the write-in operation of the VRAM within the second embodiment.

In FIG. 6, the data modifier circuit 32r consists of 8-bit registers 101 to 104, an OR gate 105, multiplexers 106 to 110 and adders 111 and 112. More specifically, the registers 101 to 104 store respective data in accordance with the clock timing of the dot clock CLk. In addition, the multiplexers 106 to 110 output respective data inputted into input terminals <1> when signals having the value of "1" (hereinafter, a signal having the value of "1" will be referred to as a 1-signal) are inputted into control terminals C thereof, and the multiplexer 106 to 110 output respective data inputted into input terminals <0> when the 1-signals are inputted into control terminals C thereof.

Figure 7:
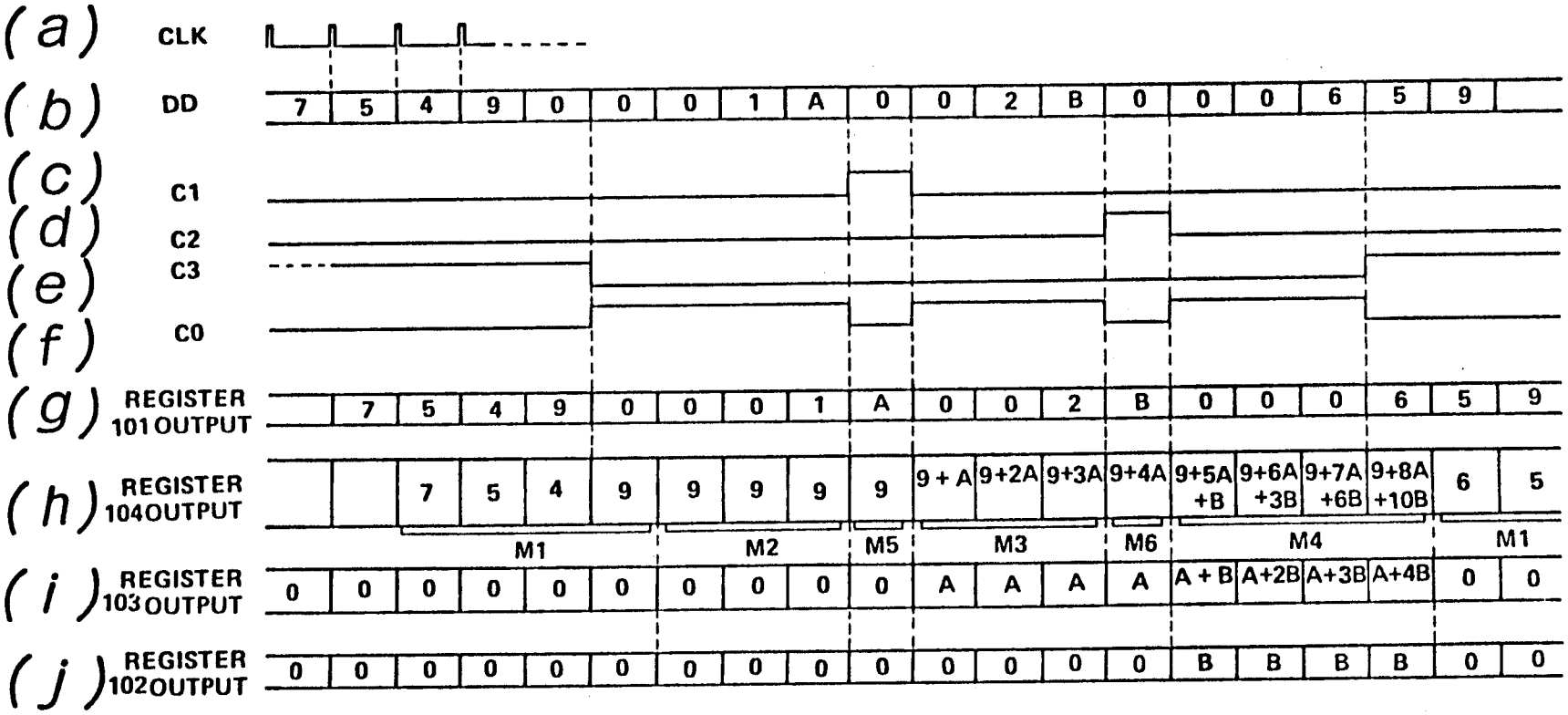
FIG. 7 shows a timing chart for explaining the operation of the second embodiment.

The modifier codes MC from the VRAM 4 are supplied to a decoder 33. The decoder 33 outputs the 1-signal from an output terminal <0> when the modifier code "0" is inputted into the decoder 33. Similarly, the decoder 33 outputs the 1 signal from an output terminal <1> when the modifier code "1" is inputted into the decoder 33, and the decoder 33 outputs the 1-signal from an output terminal <2> when the modifier code "2" inputted into the decoder 33. The output signal from one of three output terminals <0> to <2> of the decoder 33 is supplied to corresponding one of three input terminals of a register 34 wherein the output signal is delayed by one clock timing of the dot clock CLK. The two of three output terminals of the register 34 are connected to corresponding two input terminals of the register 35 wherein two output signals among the three output signals of the register 34 are delayed by one clock timing of the dot clock CLK and are outputted as signals $C_1$ and $C_2$. The three output terminals of the register 34 are connected to corresponding three input terminals of an OR gate 36 so that the OR gate 36 outputs a signal $C_0$ as the OR-result. The signals $C_0$, $C_1$ and $C_2$ are supplied to a NOR gate 37 wherein a signal $C_3$ is outputted as the NOR-result. These signals $C_1$, $C_2$ and $C_3$ are supplied to the data modifier circuit 32*r*, 32*g* and 32*b* in parallel. The waveform examples of the signals $C_1$ to $C_3$ and $C_0$ corresponding to the display data DD shown in FIG. 7(*b*) are shown in FIGS. 7(*c*) to 7(*f*).

Next, description will be given with respect to the display operation of the second embodiment shown in FIGS. 5 and 6.

The color image display apparatus according to the second embodiment provides four modes; (1) direct display mode, (2) primary coefficient load mode, (3) secondary coefficient load mode, (4) modifier display mode. Hereinafter, description will be given with respect to these four modes in turn in conjunction with a timing chart shown in FIG. 7.

(1) DIRECT DISPLAY MODE

The direct display mode will be performed when the color code CC is read out from the VRAM 4 and the preceding display data DD is not the modifier code MC having the values of "1" and "2". More specifically, the direct display mode will be performed when the color codes CC having the values of "7", "5", "4", "9", "6", "5" and "9" shown in FIG. 7 are read out from the VRAM 4. This direct display mode is roughly identical to the display operation of the conventional color image display apparatus.

First, the color codes CC outputted from the VRAM 4 are converted into the color data $D_r$, $D_g$ and $D_b$ in the color look-up table 31. The color data $D_r$ is stored in the register 101 shown in FIG. 6 at a next clock timing of the dot clock CLK, so that the output data of the register 101 (as shown in FIG. 7(*g*)) can be obtained. In this case, FIG. 7(*g*) shows not the values of the color data $D_r$ but the values of the color code CC, for convenience sake.

Meanwhile, the value of the signal $C_3$ becomes "1" as shown in FIG. 7(*e*) when register 101 outputs the data the value of which takes the value other than "0", "1", "2", "A" and "B". In this case, the output data of the register 101 inputted into the input terminal <1> of the multiplexer 110 is supplied to and is stored in the register 104 at a next leading edge timing of the dot clock CLK.

More specifically, the color code CC (excluding the color code CC which follows the modifier code MC of "1" and "2") outputted from the VRAM 4 is converted into the color data $D_r$ in the color look-up table 31 and is outputted from the register 104 after the two clock timing of the dot clock CLK (as shown by M1 in FIG. 7(*h*)). The output data of the register 104 is converted into the analog red color signal $S_r$ in the DAC 8*r*, and the red color signal $S_r$ is supplied to the CRT display unit 5. Similarly, the green color signal $S_g$ and the blue color signal $S_b$ will be generated in the DAC 8*g* and 8*b*. Therefore, the CRT display unit 5 performs the color dot display operation in response to the color code CC.

On the other hand, when the value of the signal $C_3$ becomes "1", the output 1-signal of the OR gate 105 is supplied to the control terminal C of the multiplexer 106, so that the data "0" inputted into the terminal <1> of the multiplexer 106 is outputted from the multiplexer 106. This data "0" is passed through the multiplexer 107 and is supplied to and stored in the register 102 at a next clock timing of the dot clock CLK. Hence, the register 102 is reset by the data of "0". Similarly, when the value of the signal $C_3$ becomes "1", the data "0" inputted into the terminal <1> of the multiplexer 108 is outputted from the multiplexer 108. This data "0" is supplied to and stored in the register 103 via the adder 111 and the multiplexer 109, so that the register 103 is reset by the data "0".

(2) PRIMARY COEFFICIENT LOAD MODE

When the VRAM 4 outputs the modifier code MC of "1", the data "A" following the modifier code MC of "1" (shown in FIG. 7(*b*)) is loaded to the register 103 as the primary coefficient. As shown in FIG. 7(*c*), the value of the signal $C_1$ becomes "1" when the two clock timing of the dot clock CLK is passed after a time when the VRAM 4 outputs the modifier code MC of "1". The output data "A" of the register 101 is supplied to the register 103 via the multiplexer 109 at a time when the value of the signal $C_1$ becomes "1". Thereafter, this output data "A" is stored in the register 103 at a next clock timing of the dot clock CLK as shown in FIG. 7(*i*). In addition, when the value of the signal $C_1$ becomes "1", the value of the output signal of the OR gate 105 becomes "1" so that the data "0" inputted into the terminal <1> of the multiplexer 106 is outputted from the multiplexer 106. This data "0" is passed through the multiplexer 107 and is supplied to the register 102 wherein the data "0" is stored therein at a next clock timing of the dot clock CLK. Hence, the register 102 is reset by the data "0".

(3) SECONDARY COEFFICIENT LOAD MODE

When the VRAM 4 outputs the modifier code MC of "2", the data "B" following the modifier code MC of "2" (as shown in FIG. 7(*b*)) is loaded in the register 102 as the secondary coefficient. In this case, the value of the signal $C_2$ becomes "1" (as shown in FIG. 7(*d*)) when the two clock timing of the dot clock CLK is passed after a time when the VRAM 4 outputs the modifier code MC of "2". When the value of the signal $C_2$ becomes "1", the data "B" from the register 101 is passed through the multiplexer 107 and is supplied to the register 102 wherein the data "B" is stored therein at a next clock timing of the dot clock CLK as shown in FIG. 7(*j*).

(4) MODIFIER DISPLAY MODE

The modifier display mode is performed when the modifier code MC of "0" is outputted from the VRAM 4. In this case, the value of the signal $C_0$ becomes "1" as shown in FIG. 7(*f*) when one clock timing is passed after a time when the VRAM 4 outputs the modifier code of "0". At this time, the signals $C_1$ and $C_2$ have the same value of "0" and the signal $C_0$ has the value of "1", hence, the output signal $C_3$ of the NOR gate 37 (shown in FIG. 5) has the value of "0". At the same time, the adder 112 outputs the addition result obtained from the output data of the register 104 and the output data of the multiplexer 109. This addition result of the adder 112 is passed through the multiplexer 110 and is supplied to the register 104 wherein the addition result is stored therein at a next clock timing of the dot clock CLK. In other words, in the case where the value of the signal $C_3$ is equal to "0", the data stored in the register 104 is added with the output data of the multiplexer 109 at every time when one clock of the dot clock CLK is generated. As described before, the CRT display unit 5 (shown in FIG. 5) performs the color dot display operation based on the data stored in the register 104.

Next, description will be given with respect to a display mode in the modifier display mode.

(a) CONSTANT SHADING (One Color Painting)

When the values of the two data respectively stored in the registers 102 and 103 both become "0", the adder 111 outputs the data "0". This output data "0" of the adder 111 is supplied to the adder 112 via the multiplexer 109. As a result, the data stored in the register 104 does not change as shown by M2 in FIG. 7(*h*), regardless of the dot clock CLK. Due to the data M2, the same color is repeatedly displayed at display dots.

(b) GOURAUD SHADING (Line Interpolation Shading)

When the data "0" is stored in the register 102 and the data other than the data "0" is stored in the register 103, the multiplexer 107 outputs the data "0", so that the output data of the adder 111 becomes identical to that of the register 103. Such output data of the adder 111 is supplied to the adder 112 via the multiplexer 109. In this case, the data stored in the register 103 is repeatedly added to the data stored in the register 104 at every time when one clock of the dot clock CLK is generated. Therefore, the value of the data stored in the register 104 is successively increased by a constant value corresponding to the data stored in the register 103 as shown by M3 in FIG. 7(*h*). As a result, the displayed color of the CRT display unit 5 changes linearly.

(c) PHONG SHADING (Curve Interpolation Shading)

When both of the values of two data respectively stored in the registers 102 and 103 take the values other than "0", the data stored in the register 102 is passed through the multiplexers 106 and 107 in series and is supplied to the adder 111 wherein the data stored in the register 102 is added to the data stored in the register 103. The addition result of the adder 111 is supplied to the adder 112 via the multiplexer 109. As shown in FIG. 7(*j*), since the data stored in the register 102 circulates through the multiplexers 106 and 107, the value of the data stored in the register 102 does not change, regardless of the dot clock CLK. Incidentally, the value of the data stored in the register 102 only changes in the secondary coefficient load mode as described before. Meanwhile, the data stored in the register 103 is repeatedly added with the data stored in the register 102 in response to the clock timing of the dot clock CLK. Therefore, the value of the data stored in the register 103 changes linearly, as shown in FIG. 7(*i*). Thereafter, the data stored in the register 103 is added with the data stored in the register 104 in the adder 112, and the addition result of the adder 112 is stored in the register 104 in accordance with the dot clock CLK. As shown by M4 in FIG. 7(*h*), the value of the data stored in the register 104 successively changes with a curved line, hence, the displayed color of the CRT display unit 5 changes with a curved line.

Above is the description of the display mode in the modifier display mode.

As is same to the case where the VRAM 4 outputs the modifier code MC of "0", the value of the signal $C_3$ becomes "1" (as shown in FIG. 7(*e*)) at a time when one clock timing of the dot clock CLK is passed after the VRAM 4 outputs the modifier code MC of "1" or "2" (in the primary or secondary coefficient mode). Therefore, the display operation in the primary or secondary coefficient mode is identical to the display operation in the case where the value of the modifier code MC is equal to "0". For this reason, as shown by M5 and M6 in FIG. 7(*h*), the operations in the above-mentioned (a), (b) and (c) will be performed. The data "A" following the modifier code of "1" is stored in the register 103 (as shown in FIG. 7(*i*)) after next two clock timings of the dot clock CLK. Similarly, the data "B" following the modifier code of "2" is stored in the register 102 (as shown in FIG. 7(*j*)) after next two clock timings of the dot clock CLK. As shown in FIG. 7(*h*), the above two data "A" and "B" are respectively added to the data stored in the register 104 at the same timing.

Figure 8:
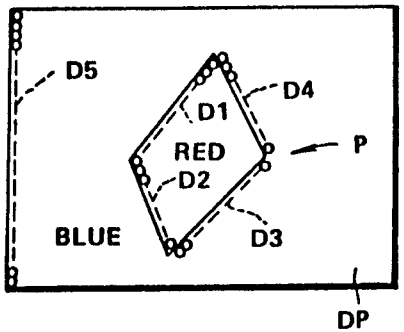

As described before, the data "0" must be pre-stored in the VRAM 4 in order to perform the above-mentioned modifier display mode when the VRAM 4 outputs the data "0" in the second embodiment. In the case where a red image P is displayed in the center of the blue background on the screen DP shown in FIG. 8, the VRAM 4 must be cleared first. Next, the red color codes are written into the VRAM 4 as display data of each display dot within the dot rows D1 and D2, and the blue color codes are written into the VRAM 4 as display data of each display dot within the dot rows D3 and D4. In addition, the blue color codes are written into the VRAM 4 as display data of each display dot within the dot row D5. In this case, the display data "0" must be written into the VRAM 4 as the display data of all display dot other than those within the dot rows D1 to D5. Due to the constant shading described before, the image P is painted by the red color and the background thereof is painted by the blue color.

Next, description will be given with respect to the case where the same color is displayed at display dots $D_a$ to $D_b$, the linearly changing color is displayed at display dots $D_c$ to $D_d$ and the color which changes with a curved line is displayed at display dots $D_e$ to $D_f$. In this case, the VRAM 4 must be cleared first. Next, a certain color code is written into the VRAM 4 as the display data of the display dot $D_a$, and the modifier code MC of "1" is written into the VRAM 4 as the display data of the display dot $D_b$. In addition, the primary coefficient (the data "A" shown in FIG. 7(*b*), for example) is written into the VRAM 4 as the display data of the display dot $D_c$, and the modifier code MC of "2" is written into the VRAM 4 as the display data of the display dot $D_d$. Furthermore, the secondary coefficient (the data "B" shown in FIG. 7(*b*), for example) is written into the VRAM 4 as the display data of the display dot $D_e$.

Above is the whole description of the present invention. This invention may be practiced or embodied in still other ways without departing from the spirit or essential character thereof. For instance, the data modifier circuit is not limited to the constitutions shown in FIGS. 2 and 6. In addition, the image displayed on the screen of the CRT display unit 5 is not limited to the color image, a black-and-white image can be also displayed on the screen. The preferred embodiments described herein are therefore illustrative and not restrictive, the scope of the invention being indicated by the appended claims and all variations which come within the meaning of the claims are intended to be embraced therein.

What is claimed is:

1. A color image display apparatus comprising:

display memory means for storing a plurality of display codes, the display memory means having means for sequentially outputting color codes;

display control means coupled to the display memory means for controlling read out and write in operations of the display memory means, the display control means having means for producing a dot clock signal and a synchronizing signal, the display control means having means for sequentially reading out color codes from the display memory means;

a data modifier circuit coupled to the display memory means, the data modifier circuit having means for receiving the color codes provided by the display memory means, the data modifier circuit having means for sequentially outputting the color codes, the data modifier circuit also being coupled to the display control means and having means for receiving the dot clock signal, the data modifier circuit comprising;

first register means coupled to the display memory means, the first register means having means for receiving the color codes, the first register means having means for storing and outputting the color codes, the first register means reading in the color codes from the display memory means in accordance with the dot clock signal;

a data detection means for detecting whether a current color code is identical to a previous color code, the data detection means being coupled to the first register means and having means for receiving the color codes, the data detection means having means for providing a detection signal, the data detection means providing a detection signal having a logic value of "0" when the current color code is different from the previous color code, the data detection means providing a detection signal having a logic value of "1" when the current color code is identical to the previous color code;

second register means for sequentially outputting the current color code, the second register means being coupled to the first register means and to the data detection means, the second register means having means for receiving the current color code provided by the first register means, the second register means also having means for receiving the detection signal from the data detection means, the second register means having means for providing a second register means output signal, the second register means sequentially storing the current color code outputted from the first register means in accordance with the dot clock signal when the detection signal has a logic value of "0", the second register means not storing the current color code when the level of the detection signal has a logic value of "1";

a color look up table circuit coupled to the display control means and having means for receiving the dot clock signal, the color look up table circuit also being coupled to the data modifier circuit, the color look up table circuit having means for receiving the color codes from the data modifier circuit, the color look up table circuit having means for converting the color codes into color data, the color look up table circuit having means for outputting the color data;

a digital to analog converter having means for receiving the color data from the color look up table circuit and having means for converting the color data into an analog color data signal; and a color display unit coupled to the digital to analog converter, the color display unit also being coupled to the display control means and having means for receiving the synchronizing signal, the color display unit having means for displaying an image corresponding to the analog color data signal received from the digital to analog converter.

2. A color image display apparatus in accordance with claim 1 wherein the data detection means is a zero detection circuit.

3. A color image display apparatus in accordance with claim 1 wherein the display memory means is a video random access memory (VRAM).

4. A color image display apparatus in accordance with claim 1 further including a system memory means for prestoring the plurality of display codes corresponding to an optimum image.

5. A color image display apparatus in accordance with claim 1 wherein the color codes indicate red, green and blue color components.

6. A color image display apparatus in accordance with claim 1 wherein the display means has a display screen arranged with a plurality of display dots, each of the plurality of display dots can display red, green and blue color.

7. A color image display apparatus in accordance with claim 5 wherein the color codes corresponding to display dots which are not representative of an image outline are stored in the display memory means and set to a predetermined value.

8. A color image display apparatus in accordance with claim 1 wherein the display control means includes a clock generating circuit.

9. A color image display apparatus comprising:

display memory means for storing a plurality of display codes, the display memory means having means for sequentially outputting color codes;

display control means coupled to the display memory means for controlling read out and write in operations of the display memory means, the display control means having means for producing a dot clock signal and a synchronizing signal, the display control means having means for sequentially reading out color codes from the display memory means;

a color look up table circuit coupled to the display memory means, the color look up table circuit having means for receiving color codes from the display memory means, the color look up table circuit also being coupled to the display control means and, the color look up table circuit having means for receiving the dot clock signal, the color look up table circuit having means for converting the color codes into color data;

a data modifier circuit coupled to the color look up table circuit, the data modifier circuit having means for receiving the color data, the data modifier circuit also being coupled to digital to analog converter, the data modifier circuit also being coupled to the display control means, the data modifier circuit having means for receiving the dot clock signal, the data modifier circuit comprising;

first register means coupled to the color look up table, the first register means having means for receiving the color codes, the first register means having means for storing and outputting the color data, the first register means reading in the color data from the color look up table in accordance with the dot clock signal;

a data detection means for detecting whether a current color data is identical to a previous color code, the data detection means being coupled to the first register means and having means for receiving the color data, the data detection means having means for providing a detection signal, the data detection means providing a detection signal having a logic value of "0" when the current color data is different from the previous color data, the data detection means providing a detection signal having a logic value of "1" when the current color data is identical to the previous color data;

second register means for sequentially outputting the current color data, the second register means being coupled to the first register means and to the data detection means, the second register means having means for receiving the current color data provided by the first register means, the second register means also having means for receiving the detection signal from the data detection means, the second register means having means for providing a second register means output signal, the second register means sequentially storing the current color data outputted from the first register means in accordance with the dot clock signal when the detection signal has a logic value of "0", the second register means not storing the current color data when the level of the detection signal has a logic value of "1";

a digital to analog converter coupled to the data modifier circuit, the digital to analog converter having means for receiving the color data, the digital to analog converter having mans for converting the color data into an analog color data signal; and a color display unit coupled to the digital to analog converter, the color display unit also being coupled to the display control means, the color display unit having means for receiving the synchronizing signal, the color display unit having means for displaying an image corresponding to the analog color data signal received from the digital to analog converter.

* * * * *